US010319519B2

(12) United States Patent
Stark et al.

(10) Patent No.: US 10,319,519 B2
(45) Date of Patent: Jun. 11, 2019

(54) METHOD FOR PRODUCING AN INDUCTION COMPONENT

(71) Applicant: Würth Elektronik eiSos GmbH & Co. KG, Waldenburg (DE)

(72) Inventors: Markus Stark, Altkrautheim (DE); Klaus Richter, Abstatt (DE); Dorian Degen, Crailsheim (DE)

(73) Assignee: Würth Elektronik eiSos GmbH & Co. KG, Waldenburg (DE)

( * ) Notice: Subject to any disclaimer, the term of this patent is extended or adjusted under 35 U.S.C. 154(b) by 132 days.

(21) Appl. No.: 15/305,871

(22) PCT Filed: Apr. 9, 2015

(86) PCT No.: PCT/EP2015/057721
§ 371 (c)(1),
(2) Date: Oct. 21, 2016

(87) PCT Pub. No.: WO2015/162016
PCT Pub. Date: Oct. 29, 2015

(65) Prior Publication Data

US 2017/0053741 A1 Feb. 23, 2017

(30) Foreign Application Priority Data

Apr. 23, 2014 (DE) ..... 10 2014 207 636

(51) Int. Cl.
*H01F 41/12* (2006.01)
*H01F 17/04* (2006.01)
(Continued)

(52) U.S. Cl.
CPC ..... *H01F 41/127* (2013.01); *H01F 17/04* (2013.01); *H01F 27/255* (2013.01);
(Continued)

(58) Field of Classification Search
CPC ..... H01F 17/02; H01F 27/29; H01F 41/04; H01F 17/04; H01F 27/255; H01F 27/292;
(Continued)

(56) References Cited

U.S. PATENT DOCUMENTS 5,507,896 A 4/1996 Yoshimura et al.
5,903,207 A 5/1999 Lampe, Jr. et al.
(Continued)

FOREIGN PATENT DOCUMENTS

JP 1993-283277 A 10/1993
JP H06181118 A 6/1994
(Continued)

*Primary Examiner* — Carl J Arbes
(74) *Attorney, Agent, or Firm* — Boyle Fredrickson, S.C.

(57) ABSTRACT

The invention proposes a method of producing induction components each containing a coil, wherein the coils are wound on a wire-winding plate, containing a multiplicity of wire-winding stubs arranged in rows and columns, using a wire which is continuous for a plurality of coils. The template provided with the coils is then pressed in a molding press with ferromagnetic substrate powder, which embeds the coils. Once the template has been removed, the interiors of the coils are provided with substrate powder, and pressed, once again in a molding press. Electrical contact is then made with the connections and the block is divided up into individual induction components each containing a coil.

14 Claims, 6 Drawing Sheets

(51) Int. Cl.

| | |
|---|---|
| ***H01F 27/29*** | (2006.01) |
| ***H01F 27/255*** | (2006.01) |
| ***H01F 41/02*** | (2006.01) |
| ***H01F 41/06*** | (2016.01) |

(52) U.S. Cl.
CPC ..... *H01F 27/292* (2013.01); *H01F 41/0246* (2013.01); *H01F 41/06* (2013.01); *H01F 2017/048* (2013.01)

(58) Field of Classification Search
CPC .... H01F 41/0246; H01F 41/06; H01F 41/127; H01F 2017/048
See application file for complete search history.

(56) References Cited

U.S. PATENT DOCUMENTS

| | | | | |
|---|---|---|---|---|
| 6,759,935 | B2 * | 7/2004 | Moro | B22F 7/08 29/602.1 |
| 7,415,757 | B2 * | 8/2008 | Satoh | A61B 8/08 29/602.1 |
| 8,174,349 | B2 | 5/2012 | Yoshida et al. | |
| 8,695,209 | B2 * | 4/2014 | Saito | H01F 27/292 29/602.1 |
| 9,761,373 | B2 | 9/2017 | Stark et al. | |
| 2001/0016977 | A1 * | 8/2001 | Moro | B22F 7/08 29/606 |
| 2002/0158739 | A1 * | 10/2002 | Shibata | H01F 17/04 336/90 |
| 2013/0112651 | A1 | 5/2013 | Lee et al. | |

FOREIGN PATENT DOCUMENTS

| | | | | |
|---|---|---|---|---|
| JP | 1995-106144 | A | | 4/1995 |
| JP | 2003297661 | A | | 10/2003 |
| JP | 2004-087607 | A | | 3/2004 |
| JP | 2005026495 | A | * | 1/2005 |
| JP | 2005116708 | A | | 4/2005 |
| JP | 2007-165477 | A | | 6/2007 |
| JP | 2010-278413 | A | | 12/2010 |
| JP | 2013-098258 | A | | 5/2013 |
| KR | 101044607 | B1 | | 6/2011 |
| KR | 101044608 | B1 | | 6/2011 |
| KR | 20110100096 | A | | 6/2013 |
| SU | 1809473 | A1 | | 4/1993 |
| WO | 2015026021 | A1 | | 2/2015 |
| WO | 2015162016 | A1 | | 10/2015 |

* cited by examiner

METHOD FOR PRODUCING AN INDUCTION COMPONENT

The invention relates to a method of producing an induction component and to an induction component produced by this method.

A method of producing an inductor is already known (KR 10-1044607). A coil core, a coil casing and a cover made of a metallic magnetic powder are produced here and pressed in a mould with the previously wound coil. The winding ends are located in the region of the end side of the inductor thus produced.

In the case of a further known method (KR 10-1044608), a multiplicity of connection terminals are incorporated in a first mould and a multiplicity of individual coils are incorporated in a second mould. The two moulds are positioned one upon the other and the coil connections are soldered to the connection terminals.

In the case of yet a further known method (KR 10-2011-0100096), a coil core, coil casing and coil cover are pressed in a mould together with the coil. Electrical contact is made at the winding ends, which are located in the end surface of the resulting inductor, by sputtering.

It is an object of the invention to provide a method of producing induction components which is easy to carry out and with the aid of which a multiplicity of induction components can be produced at the same time.

In order to achieve this object, the invention proposes a method having the features mentioned in Claim 1. Developments of the invention form the subject matter of dependent claims.

In accordance with the method, therefore, a multiplicity of coils are arranged one beside the other and embedded in a block, common to all the coils, made of pressed ferromagnetic substrate. The interior of the coils arranged in the block is filled with for example ferromagnetic substrate, which is present in powder form, and the substrate powder is then pressed. This results in a block with a multiplicity of coils. The wires leading to the windings of each coil are exposed and provided with connection contacts. Only then is the block divided up into the individual induction components, which then contain normally just a single coil. In some cases, it is also possible to divide up the block to produce induction components which contain more than one coil.

The individual coils of the multiplicity of coils may be identical to one another. However, it is likewise possible for the coils to differ from one another, both in the number of windings and in shape.

According to the invention, provision can be made, in a development of the invention, for the block to be formed only once the coils have been arranged in position, for example by the substrate powder being applied around the coils and then pressed.

However, it is likewise possible, and falls within the context of the invention, for the block to be produced, by virtue of the substrate powder being pressed, in a first instance with a cavity for each coil, said cavity corresponding in shape and size to a respective coil, and for the coils then to be inserted into the cavity.

In a development of the invention, provision can be made, in order to produce the coils, for a template which has a multiplicity of stubs arranged one beside the other and running parallel to one another. A winding wire can then produce the coils, with the aid of a suitable device, by winding around the individual stubs. Provision can be made here for use to be made of a continuous wire for a multiplicity of coils, possibly even for all the coils.

Once winding has taken place around the stubs on the template, this template can serve, at the same time, for arranging the coils in position during production of the block from ferromagnetic material. For this purpose, provision can be made for the template with the coils wound on its stubs to be incorporated in a moulding press. The substrate powder is then introduced into the moulding press until the stubs are completely covered with powder. This is followed by the substrate powder being pressed, which results in the block provided with the coils embedded therein being produced.

In a development of the invention, provision can be made for the template with the stubs to be removed from the block, the block with the hollow-interior coils then remaining. The block can then be turned round, and therefore the opening which leads into the interior of the coils is directed upwards. In this orientation, the block is incorporated in a moulding press and further substrate powder is introduced, this further substrate powder then filling the interior of the coils. A subsequent pressing operation results in the coil core being formed and being connected to the block. As an alternative, it is also possible to insert a prefabricated coil core.

In a development of the invention, provision can be made, prior to the connection contacts being applied, for the upper side of the block, that is to say the side on which the wires run between the coils, to be provided with incisions between the coils. Continuous wires can be severed during production of these incisions, and therefore the winding ends of the coils are defined, at the same time, in this way. The operation of applying the connection contacts, for example by sputtering, then takes place into the incisions, and therefore the walls of the incisions are metallized.

In a development of the invention, provision can be made for the incisions to be made between the coil regions, at the location where the block is later divided up to form the individual induction components.

It has proven to be particularly expedient for the coils to be arranged in a matrix-like arrangement, in rows and columns, in the block. The incisions are then arranged only between the rows of the coils, to be precise in the direction transverse to the course taken by the wires.

It is also possible, prior to the connection contacts being applied, for masking then to take place in rows.

Further features, details and advantage of the invention can be gathered from the claims and the abstract, which are both worded with reference to the contents of the description, from the following description of preferred embodiments of the invention and with reference to the drawing. Individual features of the different embodiments can be combined with one another in any desired manner here without departing from the framework of the invention. In the drawing:

The method proposed by the invention of producing a number of induction components at the same time will be explained hereinbelow with reference to a possible embodiment.

Figure 1:
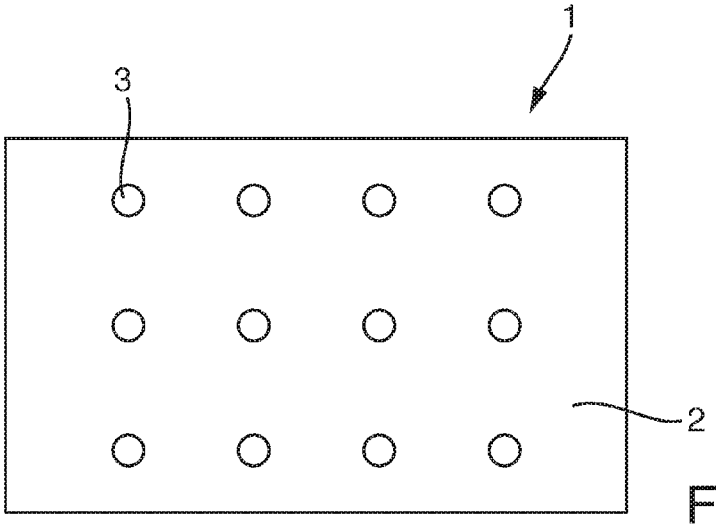
FIG. 1 shows a plan view of a template for winding a multiplicity of coils.
Figure 2:
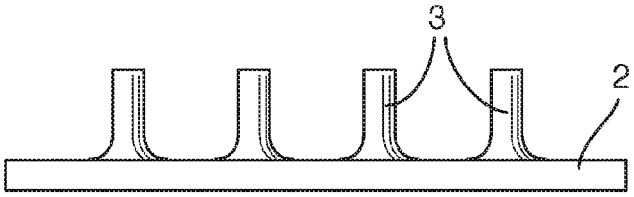
FIG. 2 shows a side view of the template from FIG. 1.

In the first instance, use is made of a template 1, which can be used a number of times. This template 1 is illustrated in FIGS. 1 and 2. It contains a wire-winding plate 2 which, in the example illustrated, is of right-angled design. Three rows of stubs 3, which are aligned in four columns, are arranged on the upper side of the wire-winding plate 2. In the example illustrated, all the circular-cylindrical stubs 3 have the same diameter and, as can be gathered from FIG. 2, the same length. All the stubs 3 on the upper side of wire-winding plate 2 run perpendicularly to the wire-winding plate and are thus oriented parallel to one another. There is an identical distance between the individual stubs 3 in the direction of the rows, and the same goes in the direction of the columns. The stubs 3 merge into the plate 2 by way of a radius, which ensures that the coil, see FIG. 14, has a conical recess on the side on which the start of the winding and winding end are located. This gives rise to the winding end and start of the winding being guided out of the coil over a radius. This prevents damage to the insulation of the winding wire and also prevents the winding wire from being bent and damaged when it is being embedded in the substrate and when the substrate is being pressed.

Figure 3:
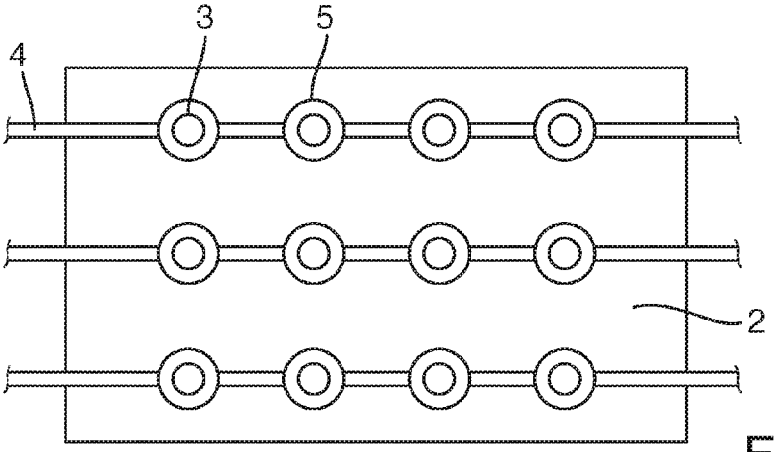
FIG. 3 shows, schematically, the plan view of the template from FIG. 1 once winding has taken place around the individual stubs.

A wire-winding machine is then used to wind, around the stubs, a wire 4 which, in the example illustrated schematically in FIG. 3, is continuous for a respective row of stubs 3. One coil 5 is thus produced for each stub 3. It is possible, for example, that they have an identical number of windings for each coil 5.

Instead of the arrangement illustrated in FIG. 3, in which use is made of a dedicated wire 4 for each row of stubs 3, it is also possible to have an arrangement in which use is made of a continuous wire 4 for all the stubs 3.

Figure 4:
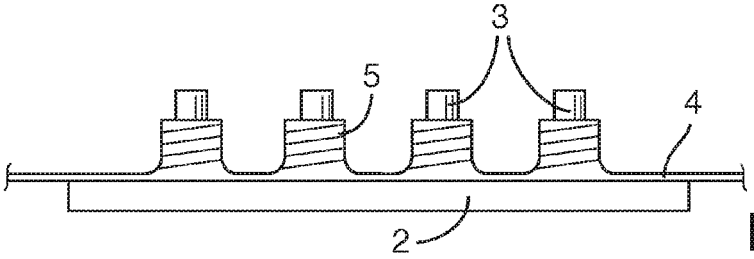
FIG. 4 shows the lateral view, corresponding to FIG. 2, of the template once the coils have been produced.

FIG. 4 shows, schematically, the wound template from FIG. 3 as seen from the side, that is to say from the same direction as the view of FIG. 2.

Figure 5:
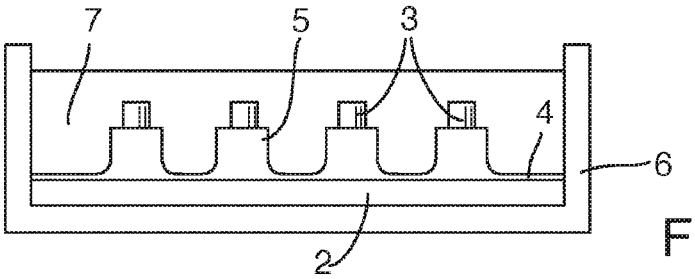
FIG. 5 shows, schematically, the arrangement of the wound template in a moulding press.

That part of the wire 4 which projects beyond the side edges of the wire-winding plate 2 is cut off, and the template 1 is then incorporated in a schematically illustrated moulding press 6, see FIG. 5. The template 1 is oriented such that the wire-winding plate 2 is located at the bottom and the stubs 3 with the coils 5 project into the interior of the moulding press 8. A first substrate powder 7 is then introduced into the interior of the moulding press 6 until the stubs 3 are completely concealed in the substrate powder 7. The substrate powder 7 is then pressed to form a solid block, this not being illustrated specifically. It is possible, for example, for a pressure of 250 kg/cm$^2$ to be applied during this pressing operation of the first substrate powder 7.

Figure 6:
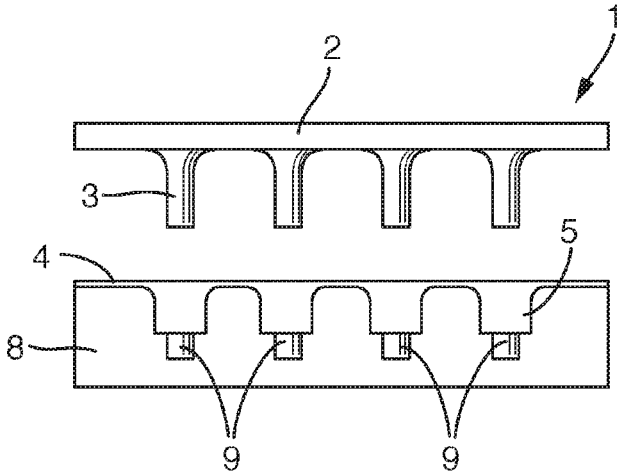
FIG. 6 shows, schematically, the block produced in the moulding press, once the template has been removed.

The block 8 pressed to this extent is then removed, with the template 1, from the moulding press 6 and turned round. Thereafter, the template 1 is removed from the block, the coils 5 now being embedded there, see FIG. 6. A cavity 9, which projects into the block 8, is now located where the stubs 3 were located beforehand.

Figure 7:
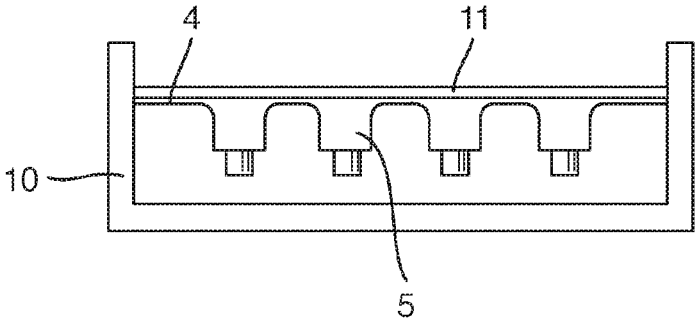
FIG. 7 shows the arrangement of the turned-around block in a moulding press.

The block 8, according to FIG. 7, is then incorporated, in its turned-round state, in a moulding press 10 once again, and a second substrate powder 11 is introduced into the openings until the interiors of the coils 5 are completely filled with substrate powder 11. The second substrate powder 11 may differ from the first substrate powder 7. It is also possible for the cavity 9 to be filled with a pre-pressed coil core, wherein interspaces are filled, in addition, with substrate powder. Then, once again, pressing takes place until the coil cores thus formed are connected to the block 8. It is possible, for example, for a pressure of 200 kg/cm$^2$ to be applied during this second pressing operation.

Figure 8:
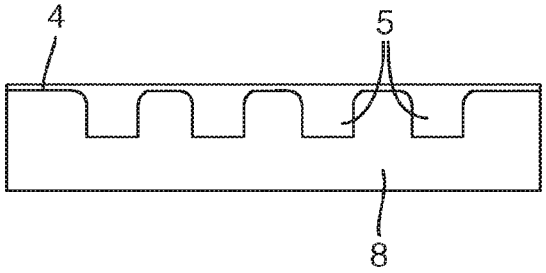
FIG. 8 shows the block with coils, removed from the moulding press from FIG. 7.

The result is a block 8 with coils 5 embedded therein, said coils each also having a coil core, and with continuous wires 4 between all the coils 5 of one row. The result is illustrated in the schematic lateral view, or in section, in FIG. 8.

If necessary, in order to achieve desired dimensions of the block 8 or of the induction components produced therefrom in the mould 10, it is possible for said block 8 to be provided with a further layer of substrate powder, said layer then being pressed. The substrate powder here may be the same as, or different from, the first substrate powder 7 or second substrate powder 11. Using different substrate powders, with differently magnetic properties, for the individual pressing operations makes it possible to set a desired level of inductance for induction components produced. It is possible, for example, for a pressure of 220 kg/cm$^2$ to be applied during this third pressing operation. The pressing operations for producing or pressing the block 8 are carried out, for example, at a pressure between 200 kg/cm$^2$ and 300 kg/cm$^2$.

The block 8 can then be pressed isostatically, the pressure here being significantly higher, for example at least ten times the pressure, in particular 4500 kg/cm$^2$, than during the preceding pressing operations. The isostatic pressing operation advantageously follows a temperature and pressure profile over time.

Figure 9:
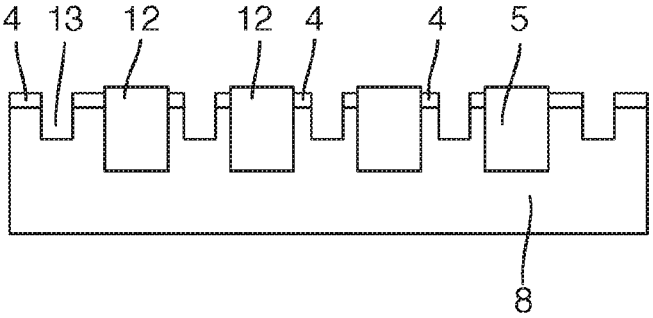
FIG. 9 shows the block once incisions have been made.

The next step is for all the coils of a column to be provided with a masking 12. Incisions 13 are then made in the block 8, between the columns of the coils 5, the depth of said incisions being less than that of the coils 5, see FIG. 9. The incisions 13 thus run transversely to the course taken by the wires 4, see FIG. 3.

Figure 10:
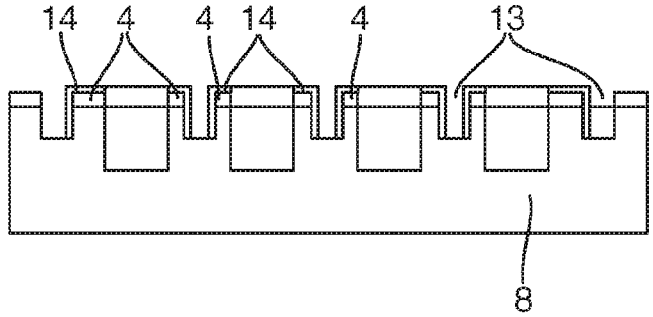
FIG. 10 shows the block once the connection contacts have been applied.

Electrical connection is then made by known methods, for example by sputtering. The metal here is applied to the surface of the block 8 and to the side walls of the incisions 13. The result is illustrated in FIG. 10, where the contacts 14 rest both on the wire structure 4 and in the incisions 13.

Thereafter, the block 8 is divided up, to be precise by way of cuts which are guided both between the rows, and between the columns, of the coils 5. The cuts here run centrally in the incisions 13.

Figure 11:
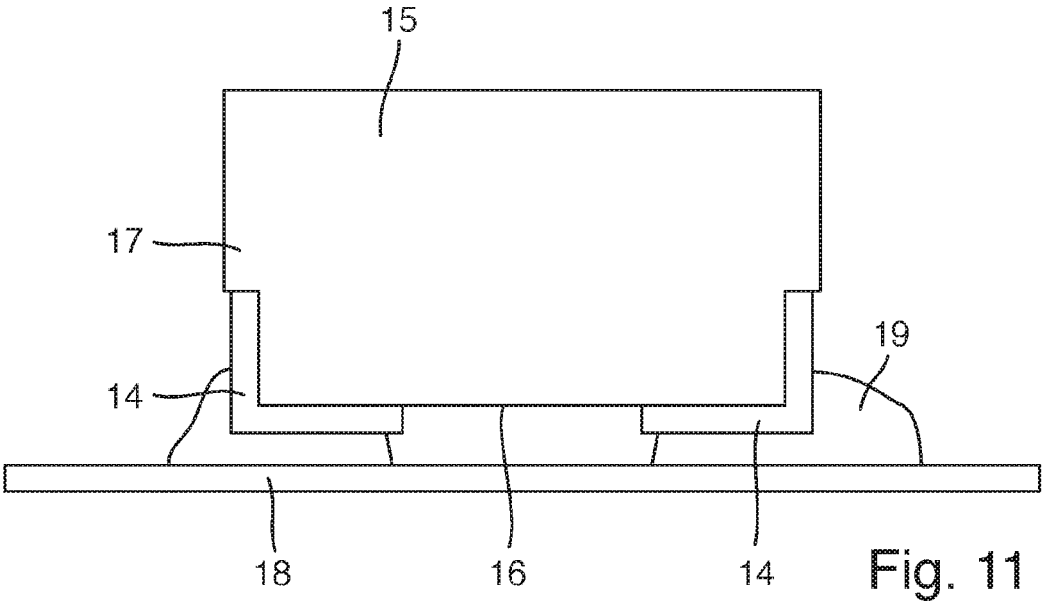
FIG. 11 shows, on an enlarged scale, a side view of an induction component produced.

This gives rise to a multiplicity of induction components 15, see FIG. 11, which have the respective connection contact 14 both on their underside 16 and on the two adjacent sides 17. In the event of soldering to a printed circuit board 18, the solder 19 also adheres to the sides 17 of the induction component 15. The presence of the solder 19 can therefore be detected optically from a direction perpendicular to the printed circuit board. This allows automatic fault detection.

Figure 12:
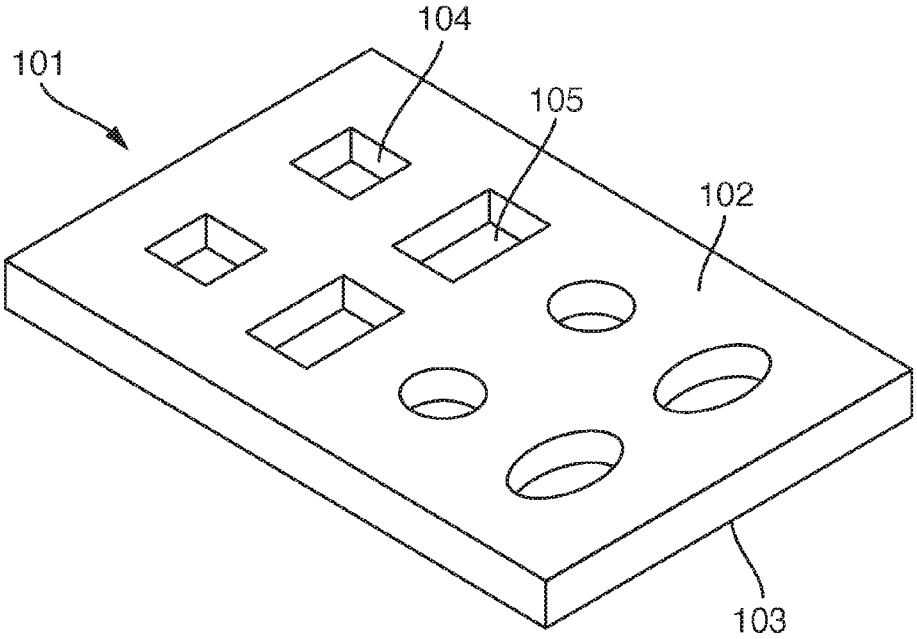
FIG. 12 shows a perspective view, in simplified form, of a block with, in this example, eight cavities of different shapes.

The method proposed by the invention will now be explained with reference to a further exemplary embodiment. FIG. 12 here shows a perspective view of a block 101 which has been produced, under high pressure, in the form of a pressed substrate from an in particular ferromagnetic powder mixture at the beginning of the method process. The block 101 is in the form of a flat rectangular plate with a planar upper side 102 and a likewise planar underside 103, which runs parallel to the upper side 102. Proceeding from the upper side 102, the block has formed in it, in the example illustrated, eight cavities 104, which are designed in the form of blind holes, that is to say each with a base 105. The example illustrated has two rectangular cavities 104, two square cavities 104, two round cavities 104 and two elliptical cavities 104. This is intended to illustrate that the block 101 can be designed for induction components of a wide variety of different shapes and sizes.

Figure 13:
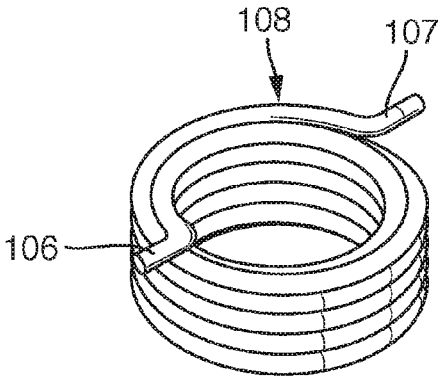
FIG. 13 shows a perspective view of a coil.

FIG. 13, then, shows the perspective view of a coil 108, which has the winding ends 106, 107 at its one axial end, illustrated at the top in FIG. 13. The two winding ends 106, 107 are bent such that they run transversally to the axis of the coil 108 and project outward beyond the outer contour of the coil 108. The two winding ends 106, 107 also run along a diameter of the coil. As can be seen, the winding ends 106, 107 are guided out of the winding over a radius.

Figure 14:
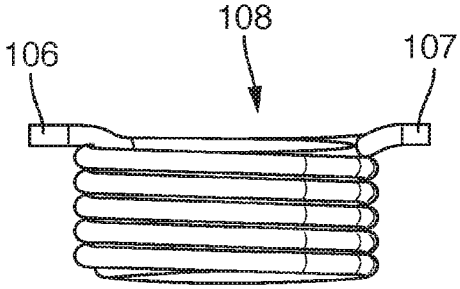
FIG. 14 shows the side view of the coil from FIG. 13.

FIG. 14 shows the coil 106 from FIG. 13 from the side. It can also be seen here that the winding ends 106, 107 of the coil-forming winding project beyond the outer contour of the coil and are located in a common plane. The winding end 106 forms the start of the winding.

The block 1 from FIG. 12 is intended, as already mentioned, for accommodating a multiplicity of coils. Continuing the method, then, all the coils 108 are inserted into the associated cavities 104. In the case of a coil 108, as shown in FIGS. 13 and 14, the cavities 104 are adapted to the coil 108 such that the winding ends 106, 107, rather than fitting into the cavity, end up in abutment against the upper side 102 of the block 101. The winding ends 106, 107 then rest in planar fashion on the upper side 102.

Figure 15:
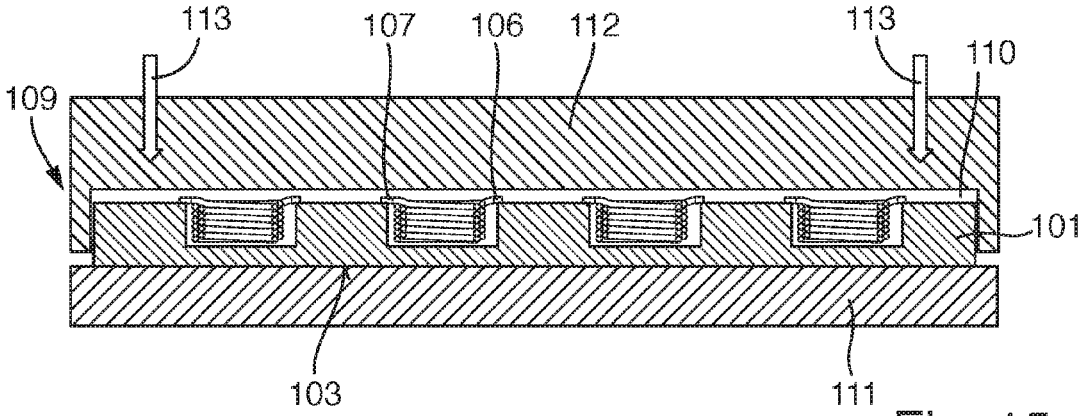
FIG. 15 shows a section through the block with coils incorporated therein.
Figure 16:
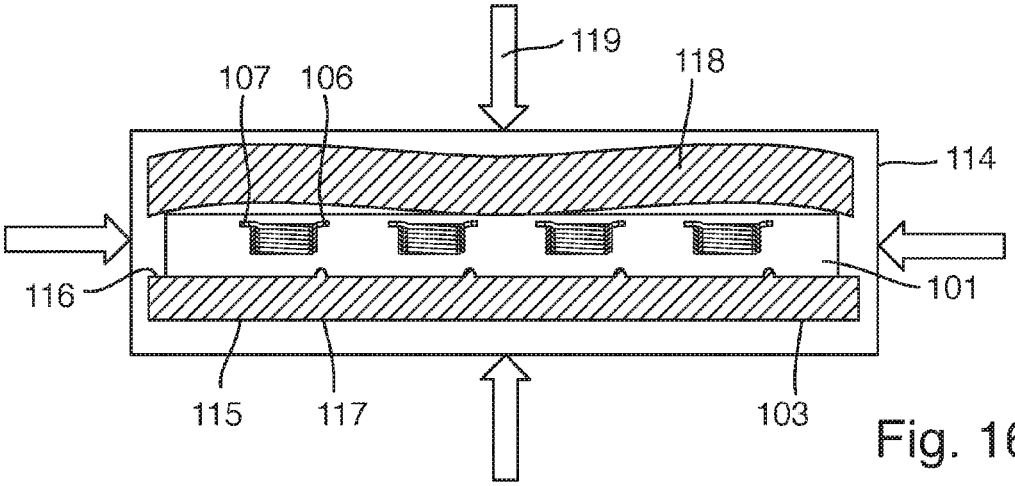
FIG. 16 shows the isostatic pressing operation.

FIG. 15, then, shows the arrangement of a block 101 in a moulding press 109. In the first instance, the coils 108 are inserted into the respective cavity 104, wherein the winding ends 106, 107 end up in abutment against the upper side 102 of the block 101. When the coils 108 are inserted into the respective cavity, it is ensured that the winding ends assume a certain orientation in relation to the cavities. The free space within each cavity is then filled up with a pulverulent substrate, in particular a ferromagnetic powder, or with a pre-pressed core and additional powder, which is filled to the extent where a layer 110 of this powder covers the upper side 102 of the block 101 throughout. The winding ends 106, 107 are located in said layer 110. The block 101 is located on a support plate 111 in the moulding press. The upper part 112 of the moulding press 109 is pressure-activated in the direction of the arrows 113, wherein the course taken by the pressure corresponds to a time/pressure profile. This profile is selected such that the energy absorbed cannot result in damage to the wire insulation or to the pre-pressed structure. It is additionally possible to have temperature activation taking place in accordance with a predetermined time/temperature profile. Once the amount of time corresponding to the profile has elapsed, the operation of pre-pressing the block 101 with the coils 108 has thus been completed. For example a first pressure ranging between 200 kg/cm$^2$ and 300 kg/cm$^2$ is applied during a pre-pressing operation.

The block 101 is then removed from the moulding press 109 and introduced into a pressure vessel 114, which is illustrated schematically in FIG. 1. The pressure vessel 114 contains a bearing plate 115 with an upper side 116 which is directed towards the block 101 and of which the surface quality does not exceed a roughness of 0.1 μm, it therefore being possible for said bearing plate also to be referred to as a polished plate. Said upper side 116 contains, for each cavity, a protrusion 117 which is in the form of a small cone and forms a marking. Each of said cones 117 is associated with the orientation of the winding ends 106, 107 of the respective coil 108, in particular with the start of the winding. In other words, the start of the winding 106 of each coil 108 is located opposite a respective cone 117. The block 101 is oriented on the bearing plate 115. A silicon layer 118 is then positioned on the layer 110, which has been applied to the upper side 102 of the block 101. The unit made up of block 101, bearing plate 115 and silicon layer 118 is then expediently packed in a liquid-tight manner and, if appropriate, evacuated. Thereafter, the pressure vessel 114 is completely filled with liquid, for example with water, and is subjected to pressure on all sides, as is indicated by the arrows 119. The silicon layer 118 should prevent damage to the winding ends 106, 107, which are contained in the layer 110, during pressure activation. The pressure activation causes the cones 117 to generate a complementary depression 21 in the underside 103 of the block 101.

During the pressure-activation operation, temperature activation also takes place. The pressure activation advantageously takes place in accordance with a predetermined time/pressure profile. The temperature activation can also follow a predetermined time/temperature profile. The pressure applied during the isostatic pressing operation is significantly higher than during the pre-pressing operation. For example, the isostatic pressing operation takes place at a maximum pressure of 4500 kg/cm$^2$ over a temperature range of 20° C. to 100° C., preferably at 80° C. The isostatic pressing operation follows a predetermined temperature profile and pressure profile over time, a so-called temperature/pressure/time profile.

Following completion of the isostatic pressing operation, the resulting block provided with the layer 110 is removed from the pressure vessel 114. The result is then illustrated on the left in FIG. 17. The underside 103 of the block 101 has formed in it the depressions 121 which are produced by the cones 117, each constitute a marking and are located opposite the respective start 108 of the winding of the coils 108.

Figure 17:
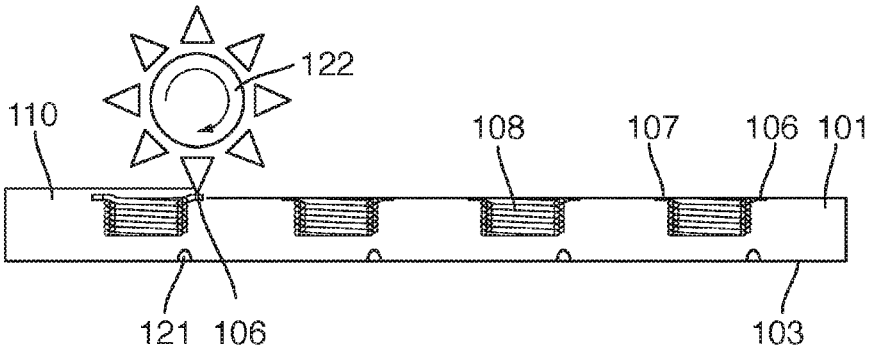
FIG. 17 shows the method step of exposing the winding ends of the coils.

Next, the upper side of the layer 110, which can still be seen at the left-hand end of FIG. 17 is removed with the aid of a grinding or milling device 122 to the extent where the winding ends 106, 107 of each coil 108 are freed of their insulation and in particular up to half the cross section thereof is exposed. This is illustrated in the right-hand part of FIG. 17.

The result is a block 101 in which the winding ends 106, 107 of all the coils 108 have been exposed. These winding ends 106, 107 can then be provided, by way of a known method, with connection contacts.

Figure 18:
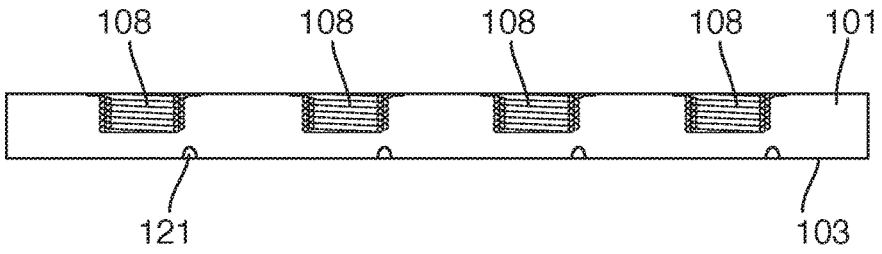
FIG. 18 shows the result of the operation of exposing the winding ends.
Figure 19:
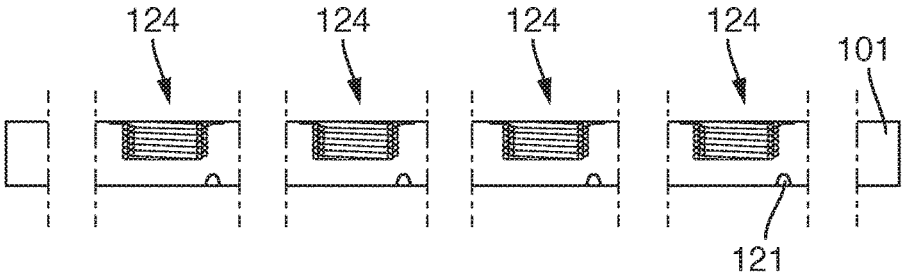
FIG. 19 shows the induction components produced by the block being divided up.

Thereafter, the induction components, which are the desired end products, are produced by virtue of the block 101 being divided up, see FIG. 19. Proceeding from FIG. 18, FIG. 19 shows how individual inductors 124 are produced from the continuous block 101 by virtue of the latter being sawn up.

Figure 20:
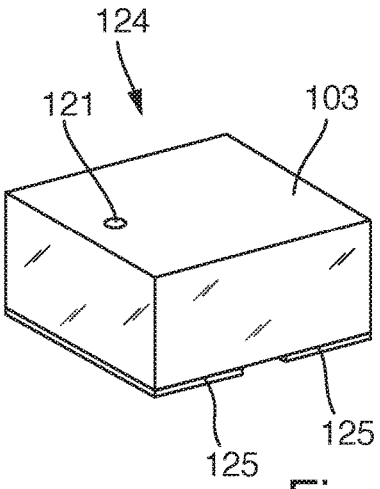
FIG. 20 shows the perspective view of an induction component according to the invention.
Figure 21:
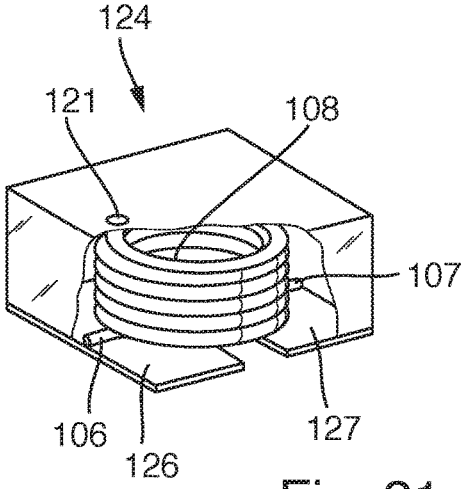
FIG. 21 shows the induction component from FIG. 20 in a partially opened state.

The following figure, FIG. 20, shows a perspective view of an inductor 124. The former underside 103 of the block 101 now forms the upper side of the inductor 124. This upper side can be seen to contain a hole 121, which has been generated by the cone 117 of the support plate 115. Two connection-contact elements 126, 127 are applied to the former upper side of the block 101, said former upper side forming the Underside of the inductor 124, and are connected electrically and mechanically to a respective winding end 106, 107. This connection between the contact elements 126, 127 and the winding ends 106, 107 is indicated in FIG. 21, which does not illustrate the ferromagnetic material, which actually tightly encloses the coils 108. Since it has been pressed by means of the polished bearing plate 115, the upper side of the inductor 124 has a very low level of surface roughness and can therefore be gripped reliably for pick-and-place purposes by extremely small suction grippers. Typically, the inductor 124 has an edge length between approximately 1 mm and 5 mm. The hole 121, which is designed in the form of a conical blind hole, is an indication of the orientation of the start 106 of the winding, and therefore the induction component 124 can be positioned automatically with desired orientation of the start 106 of the winding.

The invention claimed is:

1. A method of producing induction components, having the following method steps wherein the steps are performed in a sequential order:

a winding operation is carried out for a multiplicity of coils arranged one beside the other and having parallel coil axes;

the coils are embedded at intervals in a block made of pressed substrate;

the interior of the coils the block is filled with the substrate, which is present in powder form;

the substrate powder is pressed;

the two ends of the winding of all the coils are exposed;

the exposed ends of the coil windings are provided with connection contacts;

the block is then divided up to form the individual induction components each containing at least one coil.

2. The method according to claim 1, wherein the block (8) is formed by virtue of the substrate powder being pressed around the coils (5) arranged therein.

3. The method according to claim 1, wherein the block (8) is produced with a respective cavity, which corresponds in shape and size at least to one coil (5) of the multiplicity of coils (5), and the coils (5) are inserted into the respective cavity.

4. The method according to claim 1, wherein, in order to produce the coils (5), use is made of a template (1) with a multiplicity of stubs (3), which are arranged one beside the other and run parallel to one another and around which a wire (4) is wound.

5. The method according to claim 4, wherein the template with the coils (5) wound on its stubs (3), is incorporated in a moulding press (6), and then the substrate powder is applied to the template (1) and pressed in the moulding press (6).

6. The method according to claim 5, wherein, once the substrate powder has been pressed, the template (1) is removed from the block (8) generated by virtue of the substrate powder being pressed, the block (8) is incorporated in a moulding press (10), and then substrate is filled up into the moulding press (10), in order to fill the interior of the coils (5), and pressed.

7. The method according to claim 6, characterized in that the interior of the coils is filled up, at least in part, with a prefabricated core.

8. The method according to claim 1, wherein, prior to the connection contacts (14) being applied, incisions are cut into the upper side of the block (8), between the individual regions containing the coils (5), part of the way along the height of the block, and the connection contacts (14) are also applied to the walls of the incisions (13).

9. The method according to claim 8, wherein the incisions (13) are made at the location where the block (8) is later divided up to form the individual induction components (15).

10. The method according to claim 1, wherein the coils (5) are arranged in a matrix-like arrangement, in rows and columns, in the block (8).

11. The method according to claim 1, wherein, once the ends of the winding of all the coils (5) have been exposed, strip-like masking (12) takes place.

12. The method according to claim 1, characterized in that the block (8) is pressed isostatically, in particular in a liquid-filled pressure vessel.

13. The method according to claim 1, characterized in that the operation of exposing the ends of the coil windings takes place by means of mechanical removal.

14. An induction component, produced by the method according to claim 1.

* * * * *